United States Patent [19]

Neskora et al.

[11] 4,385,981

[45] May 31, 1983

[54] LIQUEFACTION OF CARBONOUS MATERIALS WITH VAPOR PHASE HYDROGEN DONOR SOLVENTS

[75] Inventors: Daniel R. Neskora, Westfield; Richard H. Schlosberg, New Providence, both of N.J.

[73] Assignee: Exxon Research and Engineering Co., Florham Park, N.J.

[21] Appl. No.: 255,569

[22] Filed: Apr. 20, 1981

Related U.S. Application Data

[63] Continuation of Ser. No. 172,369, Jul. 25, 1980, abandoned.

[51] Int. Cl.[3] ..... C10G 1/00

[52] U.S. Cl. ..... 208/8 R; 208/11 R

[58] Field of Search ..... 208/8 R, 11 R

[56] References Cited

U.S. PATENT DOCUMENTS

| | | | |
|---|---|---|---|
| 3,841,991 | 10/1974 | Cohen et al. | 208/8 LE |
| 4,036,731 | 7/1977 | Martin | 208/8 LE |
| 4,039,426 | 8/1977 | Schutte | 208/8 LE |
| 4,090,958 | 5/1978 | Leonard | 208/8 LE |
| 4,123,347 | 10/1978 | Maa | 208/8 |
| 4,189,371 | 2/1980 | Maa et al. | 208/8 LE |
| 4,250,014 | 2/1981 | Long et al. | 208/8 LE |
| 4,252,633 | 2/1981 | Long et al. | 208/8 R X |
| 4,253,937 | 3/1981 | Long | 208/8 LE |

FOREIGN PATENT DOCUMENTS

| | | | |
|---|---|---|---|
| 478668 | 1/1938 | United Kingdom | 208/8 LE |
| 1287570 | 8/1972 | United Kingdom | 208/8 LE |

*Primary Examiner*—Delbert E. Gantz
*Assistant Examiner*—William G. Wright
*Attorney, Agent, or Firm*—Henry E. Naylor

[57] ABSTRACT

Disclosed is a method for enhancing the conversion of carbonous materials, such as coal and oil shale. The method comprises converting the carbonous material in the presence of a vapor phase hydrogen donor material containing 1 or more hydrogen donor solvents wherein each donor material is characterized by: (a) a heterocyclic ring in which the heteroatom is nitrogen, (b) having at least one donatable hydrogen located on the heterocyclic ring, and (c) becoming more unsaturated and/or aromatic upon the loss of the donatable hydrogen(s). The conversion is performed at substantially atmospheric pressure, at an effective vapor residence time and at a temperature from about the boiling point of the hydrogen donor material to about 550° C.

7 Claims, 2 Drawing Figures

LIQUEFACTION OF CARBONOUS MATERIALS WITH VAPOR PHASE HYDROGEN DONOR SOLVENTS

This is a continuation of application Ser. No. 172,369, filed July 25, 1980, now abandoned.

BACKGROUND OF THE INVENTION

The present invention relates to a method for enhancing the conversion of carbonous materials such as coal, oil shale, and peat, to liquids, by use of specific type hydrogen donor materials under critical processing conditions.

Coal, once the leading source of energy in the United States, is beginning to play a more important role in the nation's energy future. The primary reason for the growing importance of coal is the rapid depletion of known petroleum and natural gas reserves. These known reserves are being depleted at a rate considerably faster than the rate of discovering new reserves. As the era of petroleum growth draws to a close, the world's energy mix will have to change. Transition energy sources will be needed as a bridge between petroleum and the potentially unlimited energy sources of the future; such sources being, for example, solar power and nuclear fusion. Owing to their great abundance, coal and oil shale, are perceived as the keystones of such a bridge. Consequently, much work is presently in progress to provide economical ways of converting these resources to valuable liquids and gases. Coal liquefaction processes in which coal, with or without a diluent, is subjected to elevated temperatures and pressures to convert solid coal to normally liquid hydrocarbonaceous products, are well known.

Because the ratio of hydrogen to carbon in coal derived liquids and gases is higher than coal itself, gases, much emphasis has been put on more efficient uses of hydrogen in liquefaction processes. In order to use hydrogen more efficiently, processes have been developed wherein a source of hydrogen is an organic compound, usually a solvent, which is capable of donating hydrogen to radicals formed during the decomposition of coal. Although such processes teach the conversion of coal to liquids and gases under various conditions, and with various yields, none are able to achieve relatively high conversion to liquids under low pressure conditions.

SUMMARY OF THE INVENTION

In accordance with the present invention, there is provided a method for enhancing the conversion to liquids of solid carbonous materials selected from the group consisting of coal, oil shale, peat and solid products thereof, to liquids. The method comprises converting the carbonous material in the presence of a vapor phase hydrogen donor material containing one or more effective hydrogen donor solvents wherein each effective donor solvent is characterized by: (a) a heterocyclic ring in which the heteroatom is nitrogen, (b) having at least one donatable hydrogen located on the heterocyclic ring, and (c) becoming more unsaturated and/or aromatic upon the loss of the donatable hydrogen(s). The conversion is performed at substantially atmospheric pressure, at an effective vapor residence time and at a temperature from about the boiling point of the hydrogen donor material to about 550° C.

In one embodiment of the present invention, the carbonous material is subbituminous coal, the hydrogen donor material is comprised of 1,2,3,4-tetrahydroquinoline, the pressure is atmospheric pressure, the maximum conversion temperature is about 500° C. and the donor vapor residence time is about 1 second.

In a preferred embodiment of the present invention the carbonous material is coal or oil shale and the hydrogen donor material is recycled from a product stream resulting from the practice of the present invention.

DETAILED DESCRIPTION OF THE INVENTION

Figure 1:
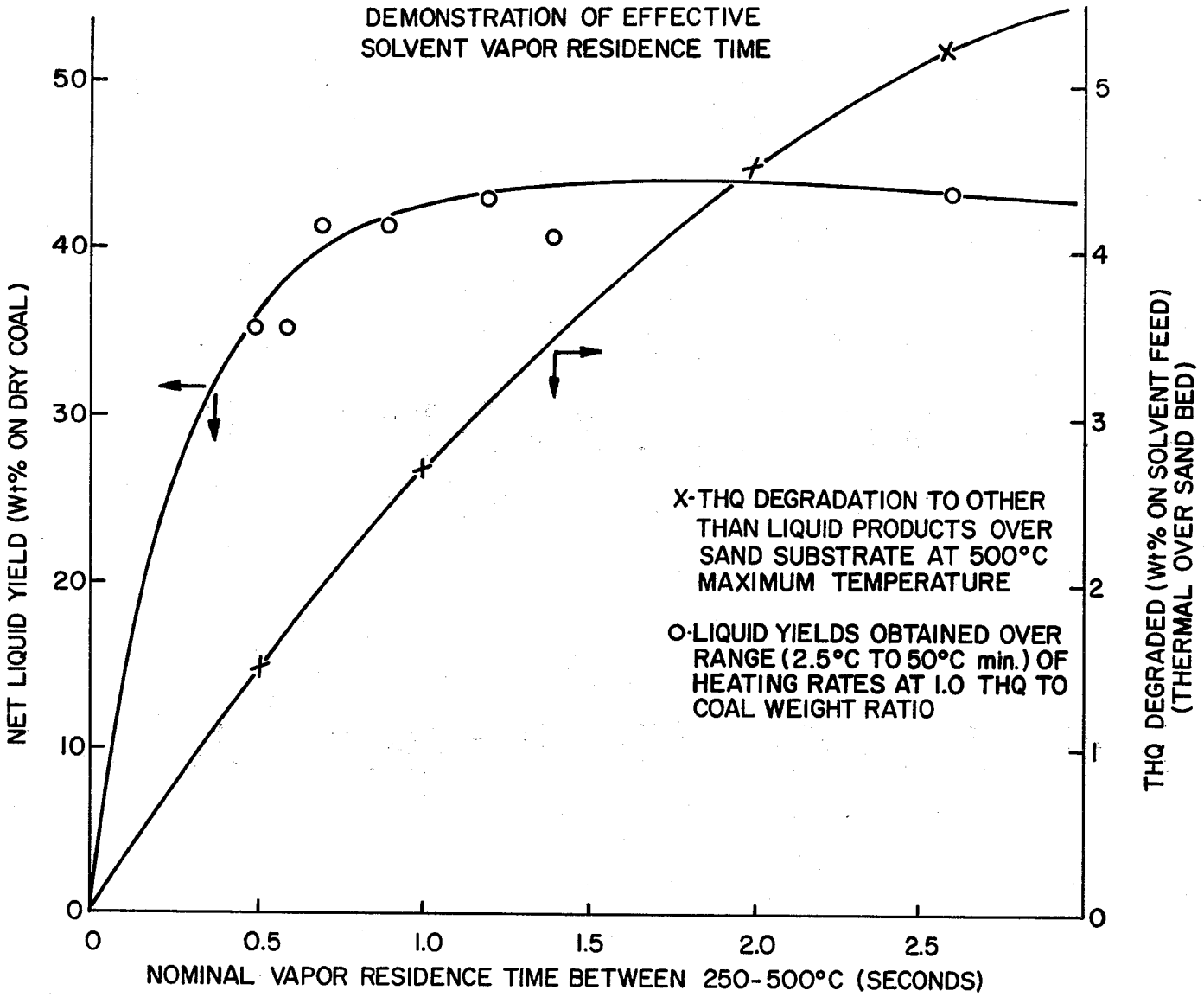
FIG. 1 illustrates the effectiveness of short vapor residence times as claimed herein.

Compounds claimed herein which are capable of donating hydrogen to carbonous material radicals under the conditions claimed herein are particularly suitable for the conversion of such materials to liquids. It is believed that the chemical mechanism which may partially account for their exceptional conversion ability results from a solvent-coal physical interaction (e.g. acid-base coordination etc.), followed by the subsequent donation of available hydrogen to the reactive carbonous fragments, thereby stabilizing the fragments as they are formed. The hydrogen donor in turn is converted, to a degree, to an aromatic form which may subsequently or concurrently be regenerated.

The art generally teaches that all known hydrogen donor compounds, which generally also serve as solvents for the coal, are suitable for converting coal to liquids and gases. We have surprisingly found that only certain specific types of hydrogen donor compounds or mixtures thereof, when used under the critical reaction conditions of the present invention, enhance the conversion of certain carbonous materials to liquids when compared to the conversion of such carbonous materials without the use of the hydrogen donor materials claimed herein.

Effective hydrogen donor compounds suitable for use herein include those compounds which: (a) contain a heterocyclic ring in which the heteroatom is nitrogen, (b) have at least one donatable hydrogen located on the heterocyclic ring, and (c) have a tendency to become more unsaturated and/or aromatic upon the loss of the dontable hydrogen(s). Non-limiting examples of such compounds include, 1,2,3,4-tetrahydroquinoline; 1,2,3,4-tetrahydroisoquinoline, 1,2,3,4-tetrahydrocarbazole, 1,2,3,4,5,6-hexahydrocarbazole, acrilan, piperidine, pyrrolidine, indoline and their alkylated derivatives and mixtures thereof. Preferred are 1,2,3,4-tetrahydroquinoline; 1,2,3,4-tetrahydroisoquinoline and indoline.

It will be noted that other conventionally used hydrogen donor materials, which do not meet the requirements set forth above, are unsuitable for use in the practice of the present invention. Such donor materials include tetralin, phenanthrene, $C_{12}$ and $C_{13}$ acenaphthenes, their hydrogenated analogs and indole.

The pressure at which the carbonous material is converted herein is preferably about atomospheric pressure (14.7 psia), although pressures slightly higher or lower may be employed to facilitate mass transfer in the processing scheme.

The temperature at which conversion occurs in the presence of the hydrogen donor vapor may range from the initial boiling point of the hydrogen donor material to about 550° C. For example, for THQ, it is preferred that the conversion temperature be about 200° C. to about 500° C., more preferably from about 250° C. to about 500° C.; most preferred is about 350° C. to about 500° C.

The residence time at which the donor vapor is in contact with the solid carbonous material, at conversion temperatures must be an effective residence time. By an effective residence time we mean a time long enough so that reaction with the carbonous material takes place, but short enough so that undesirable secondary reactions are minimized. Such undesirable reactions include donor solvent degradation (other than loss of hydrogen) and irreversible combinations of donor molecules with either the converted or unconverted carbonous material. These conditions also minimize undesirable secondary reactions of first formed carbonous material derived fragments. That is, the donor material is preferably removed from the reaction zone, and cooled, substantially immediately after donating its hydrogen. This is generally a time from about 0.1 to about 30 seconds, although less than 10 seconds is generally desired. It will be noted that less than 0.1 seconds may also be feasible when the invention is employed in specially designed, short residence time reaction vessels.

For economic reasons, a donor vapor residence time is chosen, based on the particular hydrogen donor material and the temperature employed, such that a minimal amount, e.g., no more than about 5 wt. % of the donor material is lost through degradation, other than by aromatization. The longer the vapor residence time, the greater the degree of donor degradation at any given temperature; therefore, it is preferred that a donor material and process conditions be chosen such that maximum conversion to liquids occur before about 5 wt. % of donor is spent by degradation. For example, FIG. 1 herein illustrates that at a maximum temperature of 500° C., at atmospheric pressure, at a donor to coal weight ratio of 1 to 1, and with 1,2,3,4-tetrahydroquinoline as the donor material, substantially maximum conversion to liquids is achieved within a donor vapor residence time of about seven tenths of a second. Also illustrated in FIG. 1 is a relative plot showing THQ degradation other than by aromatization at 500° C. With the teaching of the present invention as well as general knowledge known in the art, one having ordinary skill in the art can determine a sufficient residence time and optimum reaction conditions by routine experimentation.

By choosing the proper vapor residence time, substantially maximum conversion of carbonous material to liquids and recovery of the hydrogen donor material or its aromatic form in relatively high yields for hydrogenation and recycling is achieved. Recovery and hydrogenation of this material can be achieved by appropriate conventional methods suitable for such purposes. Although not wishing to be limited thereby, hydrogenation can be accomplished with hydrogen in the presence of a suitable hydrogenation catalyst. For example, hydrogenation temperatures can range from about 100° C. to about 450° C. at pressures up to about 2000 psig. A variety of hydrogenation catalysts can be employed such as those containing components from Group VIB and Group VIII, of the Periodic Table of the Elements, e.g., cobalt, molybdate or nickel molybdate, on a suitable support, such as alumina, silica, titania, etc. The hydrogenated product can then be fractionated to the desired boiling range and recycled to the reaction zone.

It is within the scope of this invention, and even preferred from a commercial point of view, that a portion, if not all of the hydrogen donor material employed herein, be derived from the liquids resulting from the practice of this invention. That is, especially in the case of oil shale, liquids derived therefrom are generally rich in cyclic nitrogen-containing compounds which can be separated from the product stream and hydrogenated, by conventional techniques, to give a recycle stream rich in the type hydrogen donor material suitable for use herein. The effectiveness of any particular recycle stream may be determined by measuring the total donatable hydrogen associated with the heterocyclic nitrogen ring of those type donor solvents claimed herein. That is, the recycle stream is analyzed by any appropriate analytical technique, such as gas chromatography, to determine its content of specific suitable donor solvents and their concentrations, on a weight percent dry carbonous material basis. After the specific type and concentration of suitable donor solvents are known, the number of donatable hydrogens on the heterocyclic nitrogen ring of the donor solvent can be easily calculated. The number of donatable hydrogens, as calculated, can then be compared to a model curve for determining the projected liquid yield for that particular concentration of donatable hydrogens. The recycle stream can then be upgraded with respect to the donor material depending on the desired liquid yield.

Figure 2:
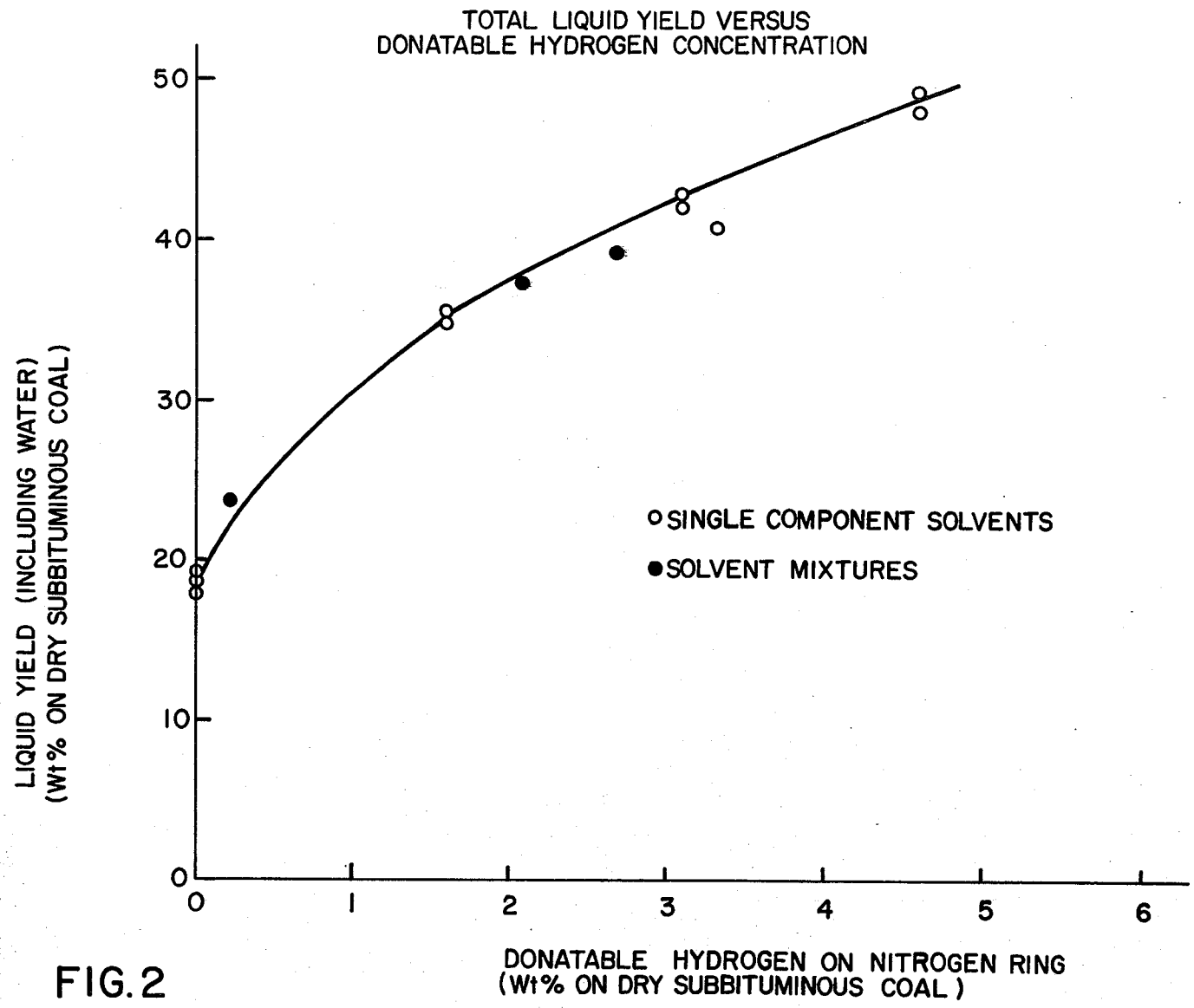
FIG. 2 illustrates total liquid yield on coal versus the donatable hydrogen concentration on the nitrogen ring of the type donor solvents employed herein.

FIG. 2 herein shows a plot of liquid yield (wt. % on dry coal bases) versus wt. % of donatable hydrogen on heterocyclic nitrogen ring on a dry coal basis, at a maximum temperature of 500° C., 1 atmosphere pressure, and helium as a sweep gas. The plot was obtained by use of model hydrogen donor solvents such as 1,2,3,4-tetrahydroquinoline; 1,2,3,4-tetrahydroiosquinoline; 1,2,3,4-tetrahydrocarbazole, and indoline and mixtures thereof at various solvent to coal ratios. Similar correlation curves can easily be prepared for oil shale and peat by routine experimentation by those having ordinary skill in the art.

The donor solvent/carbonous material ratio, on a weight basis, can range from about 0.1/1 to about 10/1, preferably about 0.1/1 to about 4/1. The optimum ratio of donor material to carbonous material will depend on such things as the particular carbonous material being converted, the processing conditions employed, and the type and the concentration of the particular donor materials comprising the recycle solvent. Of course, the optimum ratio can be determined by routine experimentation by one having ordinary skill in the art.

Generally, any type of coal, peat, oil shale or products thereof which are normally solid at room temperature may be utilized in the practice of the present invention. When coal is utilized, liquid yields from bituminous, subbituminous and lignite will be particularly enhanced. While not wishing to be limited by theory, the data herein suggest that there is a correlation between liquid yield and reactive organic functionality in the feed stock. Therefore, when coal is employed in the practice of the invention, lower rank coals are preferred because of their higher content of reactive organic functionality.

It is preferred that the carbonous material have as high a surface area as possible; although, it is not economically justifiable to pulverize the material to a very fine powder. Consequently, it is desirable to expose as much of the carbonous material surface area as possible without losing carbonous material as dust or fines or as the economics of material grinding or process equipment may dictate. Generally, the carbonous material will be ground to a finely divided state and will contain a majority of particles less than about 4 mesh, U.S. Sieve Size. The carbonous material may be dried by conventional drying techniques, for example, heating to a temperature of about 100° C. to 110° C.

In practicing the present invention, the carbonous material is fed to a reaction vessel and heated to the required temperatures. The hydrogen donor material is introduced into the reaction vessel when the temperature of the carbonous material is greater than the boiling point of the donor material.

The present invention may be practiced in various types of reaction vessels. Non-limiting examples of reaction vessels suitable for use herein include, fixed or fluid bed, as well as free fall or entrained solid reactors. The main constraint in any reactor configuration is to minimize solvent vapor residence times for any given operating temperature, and can be determined by routinely by those having ordinary skill in the art.

The following examples serve to more fully describe the manner of practicing the above-described invention, as well as to set forth the best modes contemplated for carrying out various aspects of the invention. It is understood that these examples in no way serve to limit the true scope of this invention, but rather, are presented for illustrative purposes.

COMPARATIVE EXAMPLES A-G

For each of these comparative examples, 15 g. of subbituminous coal, ground to 10/20 mesh, U.S. Sieve Size, was charged at room temperature and atmospheric pressure into a continuous gas flow batch fixed-coal bed tubular reactor. Each coal sample was subjected to the following temperature/time cycle I—heat from ambient temperature to 250° C. in 30 minutes;

II—hold at 250° C. for 60 minutes; and

III—heat from 250° C. to 550° C. in 30 minutes

Hydrogen, and/or various solvents were used during one or more of the sections I, II, and/or III of the temperature/time cycle. Table I sets forth the reagents, their use and conversion of coal to liquids and gases for each example.

TABLE I

| Comp. | Use of $H_2$/Solvent | | | Overall Solvent/Coal[1] | | | Conversion |
|---|---|---|---|---|---|---|---|
| Ex. | I | II | III | THO | Q | TET | 100-CHar |
| A | — | — | $H_2$ | — | — | — | 27 |
| B | — | $H_2$ | $H_2$ | — | — | — | 27 |
| C | THQ | $H_2$ | $H_2$ | 0.4 | — | — | 27 ± 2 |
| D | TET | TET | TET/$H_2$ | — | — | 4.2 | 27 |
| E | THQ | THQ | Q/$H_2$ | 2.9 | 1.0 | — | 28 |
| F | THQ | Q | Q/$H_2$ | 0.4 | 3.4 | — | 24 |
| G | Q | Q | TET/$H_2$ | 1.1 | — | 0.4 | 27 |

THQ = 1,2,3,4-tetrahydroquinoline
TET = Tetralin
Q = Quinoline
1 = Weight to weight basis

EXAMPLES 1-5

The procedure described in Comparative Examples A through G was followed except THQ was introduced in such a way that conversion of solid coal in liquids and gases was enhanced. Table II illustrates the judicious use of THQ.

TABLE II

| | Use of $H_2$/Solvent | | | Overall Solvent/Coal | | Conversion |
|---|---|---|---|---|---|---|
| Ex. | I | II | III | Q | THQ | 100-Char |
| 1 | THQ | THQ | $H_2$ | — | 1.7 | 35 ± 3 |
| 2 | THQ | THQ | THQ/$H_2$ | — | 3.9 | 43 |
| 3 | — | — | THQ/$H_2$ | — | 1.3 | 43 ± 1 |
| 4 | Q | Q | THQ/$H_2$ | 0.7 | 3.0 | 39 |
| 5 | — | — | THQ/10 Atm $H_2$ | — | 1.3 | 33 |

This table when compared with Table I above illustrates the following:

(a) Not all solvents, even some of those generally considered to be effective hydrogen donors under high pressure conditions, will enhance conversion of coal to liquids and gases at the low pressure conditions claimed herein, i.e., compare Comparative Example D with Example 2;

(b) the presence of hydrogen donor compound of the type claimed herein is neccesary only at elevated temperatures, i.e., compare Comparative Examples C and F with Examples 1-5; and (c) hydrogen gas by itself is not effective as the hydrogenating agent for enhancing conversion under the process conditions of the present invention. (Comparative Examples A and B)

EXAMPLE 6

The procedure of the Comparative Examples was again followed except THQ and helium were introduced at stage III of the temperature/time cycle. No reagents were introduced during stages A and B. The THQ to coal weight ratio was 1/1 and a conversion of 41 wt. % of coal to liquids and gases resulted. This example illustrates that hydrogen is not even necessary as a sweep gas.

EXAMPLES 7-17 AND COMPARATIVE EXAMPLES H-N

In each of the examples set forth in Table III below, except Examples 9, 10 and 12, 15 g. of subbituminous coal of 10/40 mesh, U.S. Sieve Size, was charged at room temperature and atmospheric pressure into a continuous gas flow batch fixed-coal bed tubular reactor. The reactor was heated to 500° C. at a rate of about 400° C. per hour and 15 g. of solvent compound was introduced over the temperature range from 250° C. to 500° C. For Example 9, 45 g. of coal and 90 g. of solvent was employed; for Example 10, 45 g. of coal and 45 g. of solvent was employed; and for Example 12, 45 g. of coal and 81 g. of solvent was employed. For vapor residence time of any given solvent compound in contact with coal was approximately 1 second and solid residence time at which coal is in contact with solvent vapor was about 40 minutes. Table III below sets forth the solvents used as well as the resulting conversion and yield data.

TABLE III

| Ex. | Solvent | Conversion wt. % Dry Coal | Yields (wt. % on Dry Coal) Char | Net. Liq. (Incl. $H_2O$) | Net Gas |
|---|---|---|---|---|---|
| Comp. H | none | 31.6 | 68.4 | 18.4 | 13.2 |
| Comp. I | 5,6,7,8-THQ[2] | 34.1 | 65.9 | 19.3 | 14.8 |
| Comp. J | TET | 33.1 | 66.9 | 16.5 | 16.6 |
| Comp. K | TET/Q 1 to 1 by wt. | 31.6 | 68.4 | 17.7 | 13.9 |
| Comp. L | DHC | 31.0 | 69.0 | 15.3 | 15.7 |
| Comp. M | Phenol/Quinoline 1 to 1 by wt. | 29.9 | 70.1 | 16.0 | 13.9 |
| Comp. N | Quinoline[2] | 29.9 | 70.3 | 17.7 | 12.0 |
| 7 | Pyrrolidine[2] | 48.1 | 51.9 | 42.3 | 5.8 |
| 8 | Indoline | 43.9 | 56.1 | 34.6 | 9.3 |
| 9 | Indoline | 51.7 | 48.3 | 41.4 | 10.3 |
| 10 | THQ[1] | 53.4 | 46.6 ± 0.8 | 41.9 ± 0.8 | 11.5 ± 0.7 |
| 11 | THIQ | 55.2 | 44.8 | 41.9 | 13.3 |
| 12 | THQ[3] | 58.0 | 42.0 | 47.0 | 11.0 |
| 13 | THC/Q 0.4 to 1 by wt. | 36.5 | 63.5 | 24.1 | 12.4 |
| 14 | THQ/THIQ/Indoline equal amounts by wt. | 50.1 | 49.9 | 38.7 | 11.4 |
| 15 | THQ/THIQ/THC/Indoline equal amounts by wt. | 48.6 | 51.4 | 37.4 | 11.2 |
| 16 | N—methylpyrrolidine[2] | 43.6 | 56.4 | 36.4 | 7.2 |
| 17 | Piperidine[2] | 44.6 | 55.4 | 39.5 | 5.1 |

[1] = average of four runs
[2] = data is corrected for solvent degradation
[3] = average of two runs
THIQ = 1,2,3,4-tetrahydroisoquinoline
THC = 1,2,3,4-tetrahydrocarbazole
DHC = 2,3-dihydrocoumarin The results shown in this Table III illustrate that in order for the solvent to significantly enhance liquid yield, under the claimed reactor conditions, a donor solvent must be employed which is characterized by (a) having a heterocyclic ring in which the heteroatom is nitrogen, (b) having at least one donatable hydrogen located on said heterocyclic ring, and (c) having a tendency to become more unsaturated and/or aromatic by donating its hydrogen. This table also illustrtes again, that hydrogen is not needed as a sweep gas in the practice of this invention for enhancing liquid yields.

Gaseous product streams resulting from selected examples were analyzed and the results are set forth in Table IV below.

TABLE IV

| Gas Component | Weight % of Gas Component on Dry Coal Basis Comp. Ex. H | Comp. Ex. J | Comp. Ex. K | Comp. Ex. N |
|---|---|---|---|---|
| $C_1$ | 1.4 | 1.8 | 1.4 | 1.3 |
| $C_2$ | 0.48 | 1.0 | 0.5 | 0.5 |
| $C_2$= | 0.2 | 0.3 | 0.2 | 0.1 |
| $C_3$ | 0.24 | 0.4 | 0.3 | 0.3 |
| $C_3$= | 0.13 | 0.5 | 0.2 | 0.2 |
| $C_4$ | 0.34 | 0.4 | 0.2 | 0.1 |
| $C_4$= | 0.19 | 0.2 | 0.2 | 0.3 |
| CO | 2.4 | 2.8 | 2.4 | 2.7 |
| $CO_2$ | 7.7 | 9.1 | 8.4 | 5.8 |
| $H_2$ | 0.07 | 0.05 | 0.11 | 0.14 |

The analysis results shown in Table IV suggest that the specific type donor solvents as claimed herein, when employed under the claimed process conditions, increase liquid yield at the expense of char and carbon oxide gases. That is, oxygen is most likely being directed to liquid product as opposed to gaseous product and char.

EXAMPLES 18 AND 19 AND COMPARATIVE EXAMPLES O AND P

In Example 18, 15 g. of Green River Oil Shale was charged at room temperature and atmospheric pressure into a continuous gas flow batch fixed-bed tubular reactor. In Example 19, 45 g. of Kentucky Devonian Oil Shale was charged, also at room temperature and pressure, into a continuous gas flow batch fixed-bed tubular reactor. The reactors were heated to a temperature of about 500° C. at a rate of about 400° C. per hour and 25 g. and 42.6 g. of THQ respectively were introduced. Identical base runs without THQ were run for comparative purposes. That is, Comparative Example O is the base for Example 18 and Comparative Example P is the base for Example 19. The vapor residence time of solvent in contact with shale was approximately 1 second and solid residence time at which the shale was in contact with solvent vapor was about 40 minutes. Helium was used as a sweep gas for all examples. The results of liquid and gaseous yield are shown in Table V below.

TABLE V

| Yields, wt. % on oil Shale | Comp. O (Base) | Ex. 18 | % Change From Base O | Comp. P (Base) | Ex. 19 | % Change From Base P |
|---|---|---|---|---|---|---|
| spent shale | 84.7 | 83.1 | −1.9 | 85.8 | 82.4 | −4.0 |
| net liquid | 11.4 | 13.8 | 21.1 | 12.6 | 16.0 | 27.0 |
| net gas[1] | 4.0 | 3.0 | −25.0 | 1.5 | 1.6 | 6.7 |
| $C_1$ | 0.34 | 0.36 | 5.9 | 0.31 | 0.26 | −16.1 |
| $C_2$–$C_5$ | 1.27 | 0.95 | −25.2 | 0.96 | 0.86 | −10.1 |
| CO | 0.43 | 0.23 | −46.5 | 0.04 | 0.15 | 275.0 |
| $CO_2$ | 1.82 | 1.49 | −18.1 | 0.16 | 0.18 | 12.5 |
| organic carbon conversion | 68.6 | 78.7 | 14.7 | 48.9 | 14.7 | 44.6 |

[1] = dose not include hydrogen yields

These examples illustrate that the present invention is suitable for enhancing liquid yields from oil shale.

What is claimed is:

1. A method for enhancing the conversion of carbonous materials to liquids wherein the carbonous material is selected from the group consisting of coal, oil shale, peat and solid products thereof, the method which comprises converting the carbonous material:

(a) in the presence of a hydrogen donor material, in the vapor phase, said donor material characterized by (aa) a heterocyclic ring in which the heteroatom is nitrogen, (ab) having at least one donatable hydrogen located on the heterocyclic ring, and (ac) becoming more aromatic upon the loss of the donated hydrogen(s); and (b) at a temperature from about 350° C. to about 550° C.; and (c) at substantially atmospheric pressure; and (d) at a vapor residence time from about 0.1 to about 30 seconds.

2. The method of claim 1 wherein the hydrogen donor material is selected from the group consisting of 1,2,3,4-tetrahydroquinoline; 1,2,3,4-tetrahydroisoquinoline; piperidine, pyrrolidine, indoline and their alkylated derivates or mixtures thereof.

3. The method of claim 2 wherein the hydrogen donor material is selected from the group consisting of 1,2,3,4-tetrahydroquinoline, 1,2,3,4-tetrahydroisoquinoline, indoline and mixtures thereof.

4. The method of claim 3 wherein at least some of the hydrogen donor material is recycle hydrogen donor material obtained from a product stream resulting from the method herein claimed.

5. The method of claim 4 wherein the vapor residence time is from about 0.5 to about 10 seconds.

6. The method of claim 5 wherein the carbonous material is oil shale or coal.

7. The method of claim 6 wherein the carbonous material is coal.

* * * * *